US008105188B1

(12) United States Patent
Mercer

(10) Patent No.: US 8,105,188 B1
(45) Date of Patent: Jan. 31, 2012

(54) ARCHERY ARROWHEAD FOR SMALL GAME

(76) Inventor: Stanley D. Mercer, Eugene, OR (US)

( * ) Notice: Subject to any disclaimer, the term of this patent is extended or adjusted under 35 U.S.C. 154(b) by 0 days.

(21) Appl. No.: 12/807,090

(22) Filed: Aug. 26, 2010

(51) Int. Cl.
*F42B 6/08* (2006.01)

(52) U.S. Cl. ..... 473/583

(58) Field of Classification Search ..... 473/578, 473/582, 583
See application file for complete search history.

(56) References Cited

U.S. PATENT DOCUMENTS 2,350,581 A 6/1944 Boose
3,241,836 A * 3/1966 Zwickey ..... 473/582
4,771,962 A * 9/1988 Gavin et al. ..... 242/521
7,311,622 B1 * 12/2007 Futtere ..... 473/583
7,314,419 B2 1/2008 Grace et al.
7,393,295 B1 * 7/2008 Futtere ..... 473/583

* cited by examiner

*Primary Examiner* — John Ricci
(74) *Attorney, Agent, or Firm* — Robert E. Howard

(57) ABSTRACT

An archery arrowhead having a body with a substantially triangular base and truncated triangular sides to form a substantially truncated triangular pyramid. A cutting blade is formed at the juncture of adjacent truncated triangular sides. Each of the cutting blades have a leading end and a trailing end. The leading ends of the cutting blades terminate in needle points. The width of the blades at their trailing ends is greater than the width of the blades at their leading ends. The leading end of the body located opposite the base has a concave recess formed therein. A concave flute is formed in each of the sides of the arrowhead.

13 Claims, 1 Drawing Sheet

ARCHERY ARROWHEAD FOR SMALL GAME

BACKGROUND OF THE INVENTION

The present invention relates to an archery arrowhead useful for hunting small game.

Archery arrowheads are designed to be secured to the tip of the shaft of an archery arrow, and, upon the arrow being shot from a bow, are the first part of the arrow to impact a target.

Many small game archery arrowheads in use today have a blunt head at the forefront thereof with two or three blades located to the rear thereof. The blunt head is the first thing to impact the game, and its function is to impart a shocking effect upon impact and to stun and harvest the game. Depending upon the kinetic energy imparted by the arrow to the game, the blunt head may penetrate the body of the game sufficiently to bring the rearward cutting blades into contact therewith.

U.S. Pat. No. 7,314,419 attempts to provide an improvement over such prior art arrowheads by providing an archery arrowhead for small game having at least one, and preferably at least three projections having a forward leading edge which can be sharpened. However, the arrowhead of this patent still has a blunt nose located forward of the projections. The projections are prone to be broken off upon impact with hard objects.

SUMMARY OF THE INVENTION

It is an object of the present invention to provide an arrowhead for small game that is a very durable and not easily broken upon impact with a hard object.

It is a further object to provide an arrowhead that can deliver blunt force trauma to small game animals.

It is a still further object to provide an arrowhead that has blades that can penetrate the body of, and cause hemorrhaging in, small game animals.

It is a still further object to provide an arrowhead that has easily resharpenable blades.

It is a still further object to provide an arrowhead that will not bury under grass and leaves, and will not hang up on tall grass to create an arrant shot.

It is a still further object to provide an arrowhead that can be easily removed from stumps, trees and logs.

The archery arrowhead of the present invention has a body with a substantially triangular base and truncated triangular sides to form a substantially truncated triangular pyramid.

A plurality of cutting blades are formed at the junctures of the truncated triangular sides. Each of the cutting blades has a leading end and a trailing end. The leading ends of the cutting blades terminate in needle points. The width of the blades at their trailing ends is greater than the width of the blades at their leading ends.

A concave recess is formed at the leading end of the arrowhead. Concave flutes are formed in each of the sides.

DESCRIPTION OF PREFERRED EMBODIMENTS

Arrowhead 10 is a generally truncated triangular pyramid having a generally triangular base 20 and generally truncated triangular sides 22, 24 and 26. By "truncated triangular pyramid" or "truncated triangular side" is meant a triangular pyramid or triangle, respectively, whose apex has been removed. It is preferred that the triangular base 20 and triangular sides 22, 23 and 26 be substantially equilateral triangles.

Figure 1:
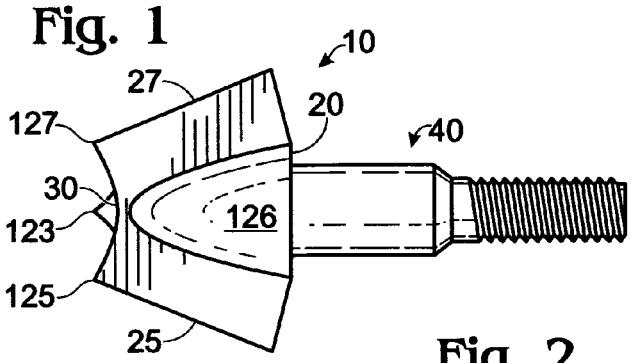
FIG. 1 is a side elevation view of the arrowhead of the present invention.
Figure 2:
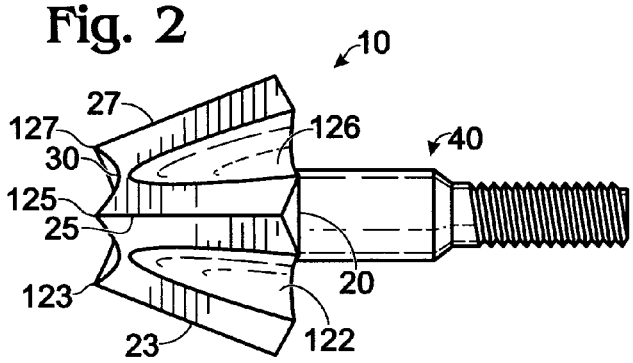
FIG. 2 is a top plan view of the arrowhead.
Figure 3:
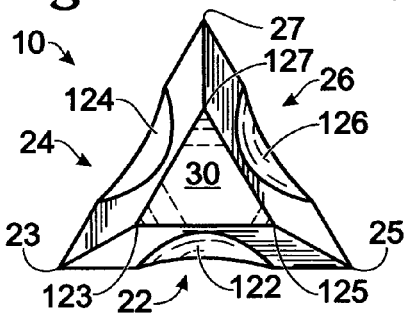
FIG. 3 is a front elevation view of the arrowhead.
Figure 4:
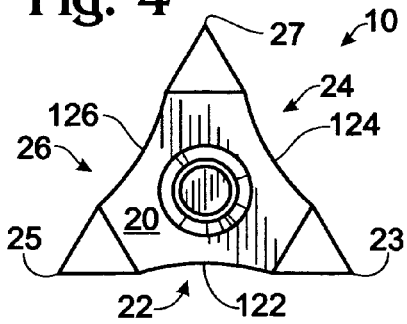
FIG. 4 is a rear elevation view of the arrowhead.

Elongated beveled cutting blades 23, 25 and 27 are formed at the juncture of truncated triangular sides 22, 24, and 26 with adjacent truncated triangular sides, i.e., the juncture of truncated triangular sides 22 and 24, 22 and 26, and 24 and 26, respectively. Cutting blades 23, 25 and 27 are sharpened in a manner to cause the trailing ends thereof to be thicker than the leading ends thereof, as best seen relative to cutting blade 25 in FIG. 2. Having the trailing end of cutting blades 23, 25 and 27 thicker than the leading end limits penetration of arrowhead 10 into trees, stumps, logs, etc., and makes it easier to remove arrowhead 10 from objects it has penetrated.

The apex of arrowhead 10 is removed to form a concave recess 30 in the shape of a spherical segment at the leading (forward) end of arrowhead 10. The formation of concave recess 30 leaves the outer ends of cutting blades 23, 25 and 27 jutting forward and terminating in needle points 123, 125 and 127, respectively.

Concave flutes 122, 124 and 126 are machined into truncated triangular sides 22, 24 and 26, respectively, and are located in the central longitudinal portions thereof. Concave flutes 122, 124 and 126 are substantially in the shape of a segment of a paraboloid. The elongated sides of concave flutes 122, 124 and 126 are substantially parallel to adjacent cutting edges of cutting blades 23, 25 and 27. The leading ends (apexes) of concave flutes 122, 124 and 126 terminate adjacent concave recess 30 at the leading end of arrowhead 10 and are curvilinear. Concave flutes 122, 124 and 126 make it easier to sharpen cutting blades 23, 25 and 27.

Arrowhead 10 is a monolithic body preferably machined from a single piece of steel so that there are no moveable or replacement parts that can cause a point of weakness. Alternatively, arrowhead 10 can be made by casting, molding, etc.

Figure 5:
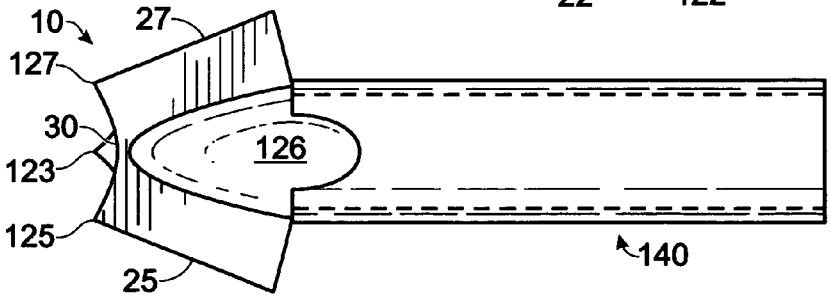
FIG. 5 is a side elevation view of arrowhead having an alternative arrow shaft attachment stem.

A male threaded arrow shaft attachment stem 40 extends rearwardly from base 20 and has a longitudinal axis that lies along the extension of the longitudinal axis of arrowhead 10. Arrow shaft attachment stem 40 is used to attach arrowhead 10 to the shaft of an arrow (not shown) of the type having a female threaded leading end in a manner well known in the art. The alternative hollow shaft attachment stem 140 shown in FIG. 5 can receive and be attached to the outer end of a non-threaded arrow shaft (not shown) in a manner also well known in the art.

Arrow shaft attachment stem 40 or 140 can be formed integral with arrowhead 10 or formed as a separate element and attached thereto.

It will be obvious to those having skill in the art that many changes may be made to the details of the above-described embodiments of this invention without departing from the underlying principles thereof. The scope of the present invention should, therefore, be determined only by the following claims.

The invention claimed is:

1. An archery arrowhead comprising:

a body having a substantially triangular base and truncated triangular sides to form a substantially truncated triangular pyramid having a longitudinal axis;

a plurality of cutting blades, each said cutting blade having a cutting edge formed at the juncture of adjacent truncated triangular sides;

said body having a leading end located opposite said base, said leading end having a concave recess formed therein.

2. The archery arrowhead of claim 1 wherein each of said cutting blades have a leading end and a trailing end, the thickness of said cutting blades being greater at the trailing end than at the leading end.

3. The archery arrowhead of claim 2 wherein each of said cutting blades terminates in a needle point at the leading end thereof.

4. The archery arrowhead of claim 1 wherein said concave recess is substantially in the shape of a spherical segment.

5. The archery arrowhead of claim 1 including a longitudinal concave flute centrally located in each of said truncated triangular sides.

6. The archery arrowhead of claim 5 wherein said longitudinal concave flute is substantially in the shape of a paraboloid whose apex is adjacent the edge of said concave recess and whose sides are substantially parallel to the cutting edges of said cutting blades.

7. The archery arrowhead of claim 1 including an arrow shaft attachment stem extending rearwardly from said base and having a longitudinal axis that lies along the extended longitudinal axis of said arrowhead.

8. The archery arrowhead of claim 7 wherein said arrow shaft attachment stem is cylindrical in shape and has a male threaded portion at its trailing end, said male threaded portion configured to mate with a female threaded portion of an arrow shaft located in the leading end thereof.

9. The archery arrowhead of claim 7 wherein said arrow shaft attachment stem is a hollow cylinder configured to receive and be attached to the leading end of an arrow shaft.

10. An archery arrowhead comprising:

a body having a substantially triangular base and truncated triangular sides to form a substantially truncated triangular pyramid having a longitudinal axis;

a plurality of cutting blades, each said cutting blade having a cutting edge formed at the juncture of adjacent truncated triangular sides, each of said cutting blades having a leading end and a trailing end, the thickness of said cutting blades being greater at the trailing end than at the leading end, each of said cutting blades terminating in a needle point at the leading end thereof;

said body having a leading end located opposite said base, said leading end having a concave recess formed therein, said concave recess being substantially in the shape of a spherical segment; and a longitudinal concave flute centrally located in each of said truncated triangular sides, each of said longitudinal concave flutes being substantially in the shape of a paraboloid whose apex is adjacent the edge of said concave recess and whose sides are substantially parallel to the cutting edges of said cutting blades.

11. The archery arrowhead of claim 10 including an arrow shaft attachment stem extending rearwardly from said base and having a longitudinal axis that lies along the extended longitudinal axis of said arrowhead.

12. The archery arrowhead of claim 11 wherein said arrow shaft attachment stem is cylindrical in shape and has a male threaded portion at its trailing end, said male threaded portion configured to mate with a female threaded portion of an arrow shaft located in the leading end thereof.

13. The archery arrowhead of claim 11 wherein said arrow shaft attachment stem is a hollow cylinder configured to receive and be attached to the leading end of an arrow shaft.

* * * * *